United States Patent [19]

Medler et al.

[11] Patent Number: 4,660,305

[45] Date of Patent: Apr. 28, 1987

[54] TAP DANCE SHOE INCLUDING INTEGRAL ELECTROMECHANICAL ENERGY CONVERSION MEANS

[76] Inventors: Charles E. Medler, Rte. 9, Box 432-B, Chapel Hill, N.C. 27514; Terry C. McInturff, Rte. 2, Box 326, Timberlake, N.C. 27583

[21] Appl. No.: 809,942

[22] Filed: Dec. 17, 1985

[51] Int. Cl.[4] ..... A43B 23/00

[52] U.S. Cl. ..... 36/139; 36/1; 36/132; 36/136

[58] Field of Search ..... 36/139, 1, 132, 136; 317/2

[56] References Cited

U.S. PATENT DOCUMENTS

| | | | |
|---|---|---|---|
| 2,320,560 | 6/1943 | Braddock | 36/139 |
| 2,419,390 | 4/1947 | Chertok | 36/1 |
| 2,420,461 | 5/1947 | Capp | 179/1 |
| 2,586,747 | 2/1952 | Atta | 36/136 |
| 2,721,420 | 10/1955 | Chatten | 46/175 |
| 2,735,220 | 2/1956 | Miles | 36/139 |
| 2,931,893 | 4/1960 | Klumpp, Jr. | 240/6.4 |
| 2,933,832 | 4/1960 | Ayala | 36/7.5 |
| 2,940,184 | 6/1960 | Malone | 36/1 |
| 2,941,315 | 6/1960 | Irving et al. | 36/1 |
| 2,976,622 | 5/1958 | Shearouse | 36/1 |
| 3,070,907 | 1/1963 | Rocco | 36/8.3 |
| 3,328,900 | 7/1967 | Weitzner | 36/1 |
| 3,406,316 | 7/1967 | Ito | 317/2 |
| 3,702,999 | 11/1972 | Gradisar | 36/8.5 |
| 3,878,641 | 4/1975 | Noble | 36/139 |
| 4,043,241 | 8/1977 | Liu | 36/139 |
| 4,253,254 | 3/1981 | Gill | 36/139 |
| 4,366,630 | 1/1983 | Bloom | 36/30 |
| 4,388,594 | 6/1983 | Deskins | 36/1 |
| 4,402,147 | 9/1983 | Wu | 36/136 |
| 4,463,506 | 8/1984 | Isackson | 36/136 |

FOREIGN PATENT DOCUMENTS

| | | | |
|---|---|---|---|
| 4511 | of 1897 | United Kingdom | 36/139 |
| 500256 | 2/1939 | United Kingdom | 36/139 |

*Primary Examiner*—Werner H. Schroeder
*Assistant Examiner*—Mary A. Ellis
*Attorney, Agent, or Firm*—Bell, Seltzer, Park & Gibson

[57] ABSTRACT

A tap for attachment to a tap dancing shoe is disclosed. The tap includes pickup means for converting the mechanical vibrational energy generated by the tap striking the floor into a substantially undistorted electrical signal suitable for remote processing and amplification. Also disclosed is a wireless radio transmission system adapted to be carried by a dancer using the shoe whereby the electrical signals picked up by the pickup means are transmitted to a remote receiver/amplifier unit.

19 Claims, 4 Drawing Figures

TAP DANCE SHOE INCLUDING INTEGRAL ELECTROMECHANICAL ENERGY CONVERSION MEANS

FIELD OF THE INVENTION

This invention relates generally to the field of exhibition tap dancing.

SUMMARY AND BACKGROUND OF THE INENTION

There are a number of popular forms of exhibition dancing, known broadly as tap dancing, wherein a step dance is tapped out audibly as a result of the dancer's shoe striking the dance floor. In order to increase the sound to an audible level for the benefit of the audience, the tap dancer's shoes may be provided with hard soles or with soles and/or heels to which taps made of metal or other suitable material have been added. In another form of tap dancing, known as clogging or clog dancing, the dancer often wears a clog, which is a shoe or sandal having a thick, sometimes wooden, sole. In still another form of tap dancing, known as soft shoe, the dancer's shoes are soft-soled.

Obviously, the size of the audience which may view and enjoy a tap dance performance is limited by the volume of sound which a dancer can produce without distortion. Also, as the audience increases in size, background noise will tend to overpower the sounds which the dancer generates. Further, the audience can become so large so as to necessitate seating of some persons at a distance beyond that which the sounds can travel at an acceptable volume.

Tap dance instructors have faced an additional problem teaching students new dance steps—namely, as soon as the instructor demonstrates the step to a group of students, they immediately try to duplicate it and thus the instructor's audible steps are overpowered.

In response to the above-mentioned problems, attempts have been made to increase the sound volume produced when the tap strikes the dance floor by a method known in the performing arts as "miking the floor." This technique incorporates a series of microphones spaced apart near the surface of the dance floor which pick up and amplify the sound waves as they travel through the air. The technique, however, is not without its own problems since the construction of the dance floor can vary across its surface due to variation in supports, loose boards, etc., thus introducing distortion into the original signal. In addition, further distortion is introduced into the signal by the sound waves traveling through the air to the microphone, all of which distorted sound is amplified in the sound system.

Another attempted solution to the problem employs a directional microphone pointed at the performer's feet. The sound produced by the performer is amplified in a manner similar to that described above. However, the aforementioned problems associated with "miking the floor" are still present. In addition, substantial cost is involved in acquiring and operating the directional microphone, thus placing it out of reach of many performers and instructors.

It would also be desirable to be able to integrate tap dancing with currently available technology such as synthesizers, Kurzweil machines and the like in order to achieve special sound effects. For example, the art could be expanded by making it possible for a performer to take advantage of the different tonal qualities available from a variety of dance floor surfaces such as wood, carpet or even street surfaces.

The present invention overcomes the drawbacks inherent in these prior art attempts to amplify the tap dancing sounds by providing a tap dancing shoe for use in exhibition type dancing which enables a dancer to amplify the sound volume while maintaining sound quality made during tap dancing. In accordance with the invention, this dancing shoe is provided with pickup means positioned in the shoe for picking up and converting mechanical vibrational energy generated as a result of the shoe contacting the dance floor into an electrical signal. This electrical signal may then be used to achieve special effects, or transmitted directly to an amplifier.

More specifically, pickup means are mounted in or attached to the bottom of the dancing shoe in close proximity to, or in contact with, the floor striking surface of the shoe. These pickup means serve to receive and connect the mechanical vibrational energy created by the shoe striking the dance floor into an electrical signal representation thereof. This electrical signal is then transmitted to a receiver and amplifier unit which then amplifies the signal as desired. The circuit may also include a "mixer" to produce special effects by combining the electrical tap dance signal, with other electrical signals, such as those representing musical instruments, etc.

DETAILED DESCRIPTION OF THE ILLUSTRATED EMBODIMENT

While the present invention will be described hereinafter with reference to the accompanying drawings in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts, and not as limiting upon the present invention.

The preferred embodiment will be discussed herein with specific reference to a tap dancing shoe; however, it will be noted note that in the specification the words "tap" and "tap dancing" are used to generically describe any type of dancing wherein a portion of the performance value is obtained by generating sound as the various portions of the shoe contact the dance floor.

Figure 1:
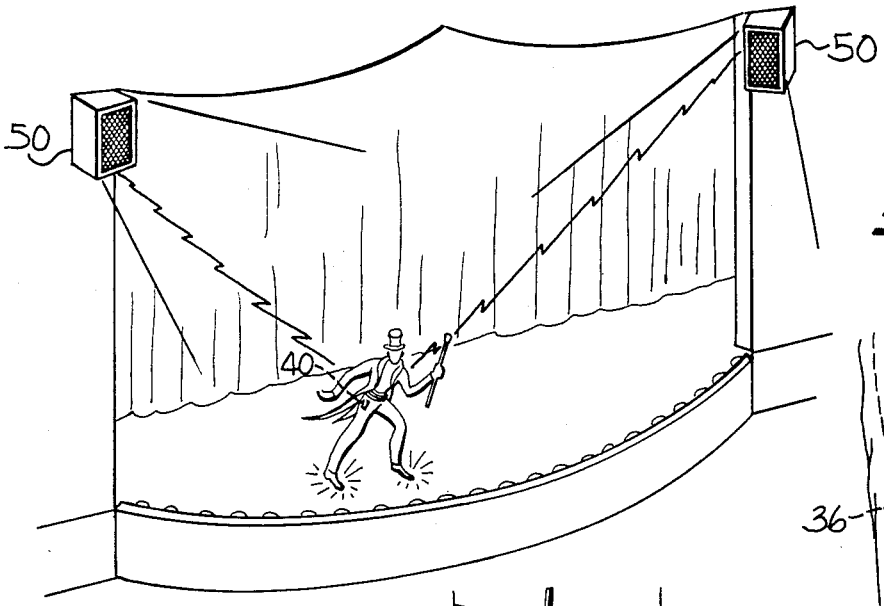
FIG. 1 is a view of a dancer on a stage utilizing the present invention to amplify the sound volume produced during tap dancing.
Figure 2:
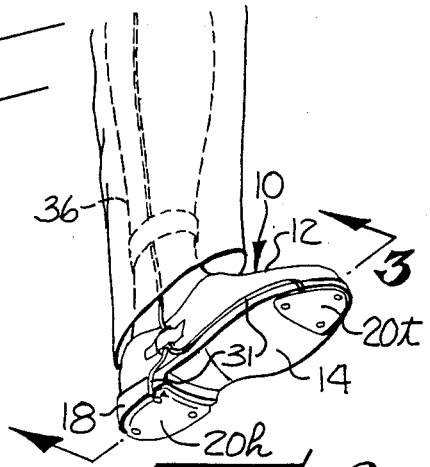
FIG. 2 is a perspective view of a tap dancing shoe including the pickup means.

Referring to FIGS. 1 and 2, the tap dance shoe generally indicated at 10 comprises an upper 12 and a sole 14 attached thereto by suitable means such as stitching (not shown). Connected to the underside of the sole 14 is a heel 18.

A pair of substantially hollow taps 20 for each shoe are shown in the illustrated embodiment. A first tap 20*t* is adapted to be mounted on the toe portion of the shoe sole, and a second tap 20*h* is similarly adapted to be mounted to the heel portion of the shoe. Mounted within each tap is a pickup means 30 for converting the mechanical vibrational energy (MVE) produced as a result of the tap contacting the dance floor into an electrical signal representation thereof. Any suitable pickup means, such as transducers of the piezoelectric, quartz, magnetic, ceramic, dynamic, or carbon type, may be used for this purpose. The pickup means 30 is glued or otherwise suitably attached in a contacting relation to the inside portion of the tap. As best illustrated in FIGS. 3 and 4, the height of the tap 20 is preferably approximately equal to the thickness of the pickup means 30 so that no special modification of either the tap or the shoe is needed in order to attach the taps and pickup means to the bottom of the shoe sole.

Attached to the pickup means 30 is one end of a wire 31 which extends through suitably sized U-shaped opening 32 in the side wall of the tap. The wire 31 carries the electrical signal representation of the MVE which is produced when the tap strikes the dance floor so that the same may be further transmitted as will be described hereinbelow. The other end of wire 31 is connected to a suitable connector 33.

Figure 3:
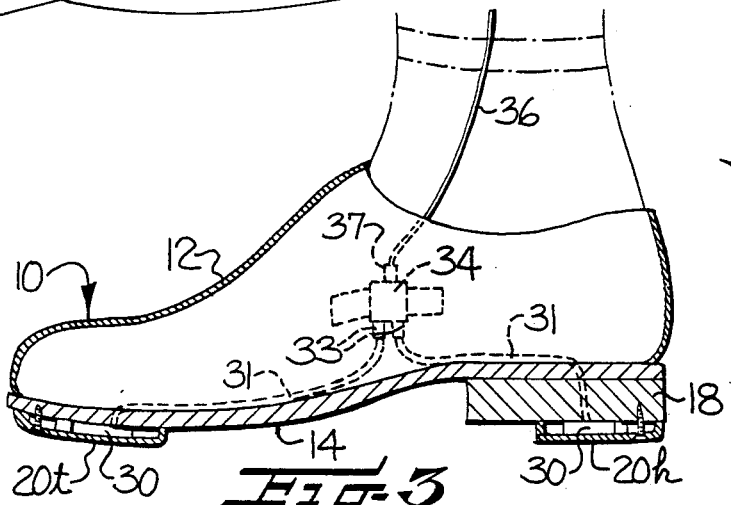
FIG. 3 is a section view taken along line 3—3 of FIG. 2 through the tap dancing shoe including the pickup means.
Figure 4:
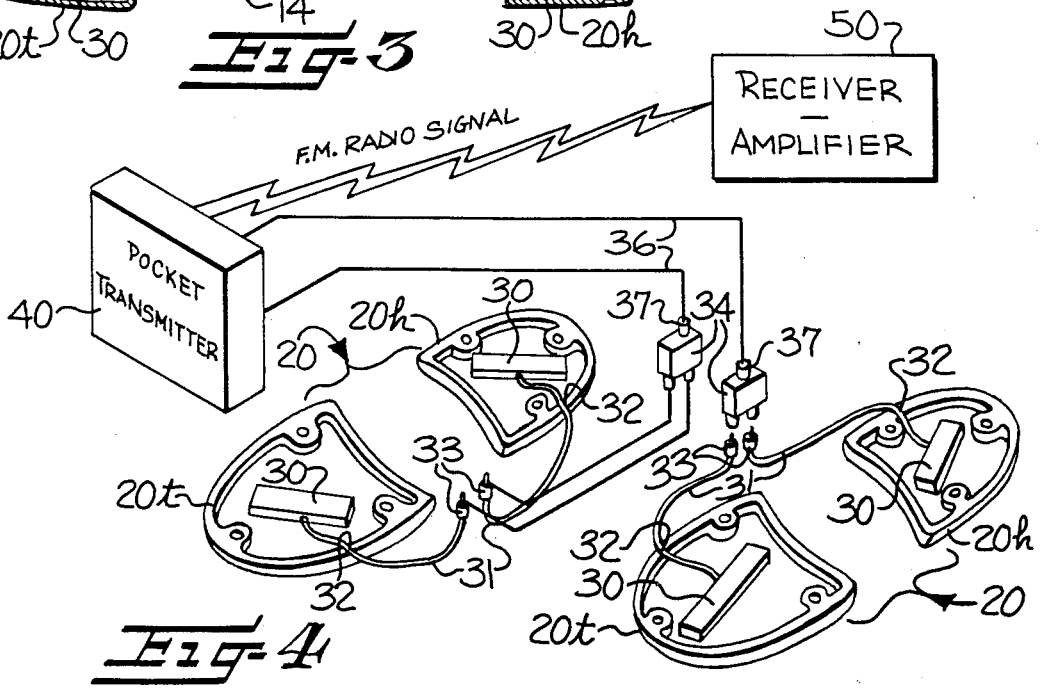
FIG. 4 is a schematic view of a pair of the taps connected to a pocket transmitter and sending a radio signal to a receiver-amplifier unit.

A shielded "Y"-adapter 34, is mounted to the outside of the shoe upper 12 near where the extensor portion of the foot would be located as shown in FIGS. 2 and 3. The adapter 34 may be attached to the shoe in any suitable fashion, such as with "Velcro" or adhesive tape. The terminals of the connectors 33 from each of the pickup means 30 located in the toe and heel taps 20*t*, 20*h* are adapted to be received by the two inputs of the "Y"-adapter 34.

The output of the "Y"-adapter 34 is wired to a battery-powered transmitter means 40 by a suitable connector such as wire 36 having a male plug 37 on the end which is joined to the "Y" adapter 34 and male phono plug (not shown) at the end which is connected to transmitter means 40. The transmitter means 40 may be any suitable transmitter, such as a battery-powered wide band FM transmitter. This transmitter is preferably small enough to be carried in the rear pocket of the wearer or in some other suitable location, and preferably should have an operating range of about 1500 feet under line of sight conditions, a frequency response of 25–20,000 Hz (±3 dB), and a signal noise ratio of about 102 dB. A radio signal receiver 50 receives the signal from the transmitter means 40 and amplifies this signal for broadcast to the audience.

As an alternative, if desired, the dancer may be hardwired directly to the receiver-amplifier, in which case the electrical wires 31 and 36 would serve as the transmitter means for transmitting the electrical signals directly from the pickup means 30 to the receiver-amplifier 50. However, it is believed that the present preferred embodiment of the invention, which includes a wireless transmitter for this purpose, offers significant advantages to a dancer in view of the added mobility provided thereby.

In the operation of the invention, the dancer activates the FM receiver-amplifier 50 and FM transmitter 40. The performance may then be commenced in the usual manner and the mechanical vibrational energy produced as a result of the shoe soles contacting the floor is directly converted into corresponding electrical signal representations thereof by the pickup means 30 located in each tap of each shoe. These signal representations are then transmitted via the wires and connectors provided to the transmitter 40 without any substantial distortion being introduced into the signal. These electrical signals are then converted by the transmitter 40 into radio signals which are transmitted to the receiver-amplifier 50 thereby producing an amplified signal which is output to the speakers 60 (FIG. 1).

If desired, the receiver and amplifier 50 may be directly connected to an electrical apparatus such as a synthesizer or the like for further processing of the electrical signal in order to achieve special effects.

Thus, the present invention makes available to the performer a wide variety of special effects which were heretofore not available. For example, a dancer may perform on a surface such as wood, carpet, or even a street and the sound volume produced will be independent of the vibrational characteristics of the surface upon which the performance takes place. In addition, the tonal quality of the surface upon which the performance has taken place is, for the first time, available to the performer in order to expand the range of the sounds produced during the performance.

Furthermore, since the signal produced is an electrical signal representation of the actual mechanical vibrational energy, it may be supplied as an input into a signal processing device for the production of special effects. For example, with the use of synthesizers, the sounds produced during a performance may be made to sound like a violin, or virtually any other type of instrument depending on the specific effect desired. Thus, both the volume and the quality of the sound produced is such that studio recording is now possible since a perfect mix can be obtained between the tap dancer and the studio musicians.

In the drawings and specification, there has been set forth a preferred embodiment of the invention, and although specific terms were employed, they are used in a generic sense only, and not for the purposes of limitation.

That which is claimed is:

1. A tap dancing shoe adapted for use in exhibition tap dancing of the type wherein sound in the form of mechanical vibrational energy (MVE) generated by a dancer using the shoe may be amplified, said shoe comprising:

a shoe upper;

a shoe sole connected to said upper and having a floor striking surface for contacting the dance floor and causing sound in the form of mechanical vibrational energy to be generated;

pickup means positioned in the shoe for receiving in substantially undistorted form said mechanical vibrational energy and for converting said energy into electrical signals which are representative thereof; and transmitter means electrically connected to said pickup means for receiving said electrical signals and transmitting the same to an amplifier for conversion into amplified sound which is representative of the sound generated by the shoe sole striking the dance floor.

2. A tap dancing shoe according to claim 1 wherein said floor striking surface of said shoe sole includes a tap mounted on said sole, and wherein said pickup means is mounted between said tap and said sole so that the mechanical vibrational energy produced when said tap strikes the floor is transmitted directty to said pickup means substantially free from distortion.

3. A tap dancing shoe according to claim 2 wherein said pickup means is mounted in contacting relation with said tap.

4. A tap dancing shoe according to claim 1 wherein said floor striking surface of said shoe sole includes a first tap mounted on said sole near the toe portion of said shoe and a second tap mounted on said sole near the heel portion of said shoe, and wherein said pickup means are mounted between each of said taps and said sole so that the mechanical vibrational energy produced when said taps strike the floor is transmitted directly to said pickup means substantially free from distortion.

5. A tap dancing shoe according to claim 4 wherein said pickup means are mounted in contacting relation with said taps.

6. A tap dancing shoe according to claim 1 wherein said means for transmitting said electrical signals include a battery-powered radio transmitter.

7. An attachment for a tap dancing shoe and the like, said attachment being adapted to pick up sound in the form of mechanical vibrational energy which is generated as a result of the sole of the shoe striking a dance floor and to convert the sound into an amplifiable electrical signal, said attachment comprising:

a tap adapted to be attached to the sole of the shoe, and pickup means carried by said tap in contacting relation to the inside of the tap for directly receiving in substantially undistorted form mechanical vibrational energy generated as a result of said tap contacting the floor and for converting said energy into electrical signals that are representative thereof.

8. An attachment according to claim 7 further comprising transmitter means electrically connected to said pickup means for receiving said electrical signals and transmitting the same to an amplifier for conversion into amplified sound.

9. An attachment according to claim 8 wherein said transmitter means include a battery-powered radio transmitter.

10. A tap dancing shoe according to claim 1 wherein said pickup means is a transducer selected from the group consisting of: piezoelectric, quartz, magnetic, ceramic, dynamic and carbon.

11. A tap dancing shoe according to claim 2 wherein the height of the tap is approximately equal to the thickness of the pickup means.

12. A tap dancing shoe according to claim 1 wherein said transmitter means comprises a battery-powered wide band FM transmitter.

13. A tap dancing shoe according to claim 12 wherein said transmitter is adapted to be carried in the rear pocket or other suitable location on the body of a dancer utilizing the tap dancing shoe.

14. A tap dancing shoe according to claim 12 wherein said FM transmitter has an operating range on the order of about 1,500 feet under line of sight conditions, a frequency response on the order of 25–25,000 Hz (±3 dB), and a signal noise ratio on the order of about 102 dB.

15. A tap dancing shoe according to claim 7 wherein said pickup means is a transducer selected from the group consisting of: piezoelectric, quartz, magnetic, ceramic, dynamic and carbon.

16. A tap dancing shoe according to claim 7 wherein the height of the tap is approximately equal to the thickness of the pickup means.

17. A tap dancing shoe according to claim 7 wherein said transmitter means comprises a battery-powered wide band FM transmitter.

18. A tap dancing shoe according to claim 7 wherein said transmitter is adapted to be carried in the rear pocket or other suitable location on the body of a dancer utilizing the tap dancing shoe.

19. A tap dancing shoe according to claim 7 wherein said FM transmitter has an operating range on the order of about 1,500 feet under line of sight conditions, a frequency response on the order of 25–25,000 Hz (±3 dB), and a signal noise ratio on the order of about 102 dB.

* * * * *